US011619398B2

(12) United States Patent
Bruckbauer

(10) Patent No.: US 11,619,398 B2
(45) Date of Patent: Apr. 4, 2023

(54) INFLOW NOZZLE

(71) Applicant: Wilhelm Bruckbauer, Neubeuern (DE)

(72) Inventor: Wilhelm Bruckbauer, Neubeuern (DE)

(73) Assignee: Wilhelm Bruckbauer, Neubeuern (DE)

( * ) Notice: Subject to any disclaimer, the term of this patent is extended or adjusted under 35 U.S.C. 154(b) by 231 days.

(21) Appl. No.: 17/011,453

(22) Filed: Sep. 3, 2020

(65) Prior Publication Data

US 2021/0071878 A1 Mar. 11, 2021

(30) Foreign Application Priority Data

Sep. 6, 2019 (DE) ..... 102019213610.9

(51) Int. Cl.
*F24C 15/20* (2006.01)
*F24C 15/10* (2006.01)

(52) U.S. Cl.
CPC ..... *F24C 15/2042* (2013.01); *F24C 15/101* (2013.01); *F24C 15/2035* (2013.01)

(58) Field of Classification Search
CPC . A47J 36/38; B01D 46/0043; B01D 46/0031; B01D 21/0045; B01D 17/045; B01D 29/00; B01D 29/05; B01D 29/13; B01D 46/00; B01D 29/01; B01D 17/047; F24C 15/2042; F24C 15/101; F24C 15/2035; F24C 15/10; F04D 29/70; F04D 29/701
USPC ..... 126/299 D, 299 E, 300, 299 F; 210/521
See application file for complete search history.

(56) References Cited

U.S. PATENT DOCUMENTS 5,762,810 A * 6/1998 Pelton ..... B01D 17/045 210/DIG. 5
6,098,354 A * 8/2000 Skandis ..... E01C 13/045 52/177
6,237,720 B1 * 5/2001 Sutton ..... F01M 11/0004 184/106
8,225,566 B2 * 7/2012 Prevost ..... E01C 13/08 52/302.1
8,561,922 B2 * 10/2013 Staedtler ..... E03C 1/08 239/553.3
2013/0340742 A1 * 12/2013 Sosso ..... F24C 15/2042 126/299 D
2019/0063848 A1 * 2/2019 Miller ..... F28F 13/06
2019/0316786 A1 * 10/2019 Crudo ..... F24C 15/2085

FOREIGN PATENT DOCUMENTS

DE 202011005698 U1 4/2011
DE 102016107190 B3 4/2016
EP 3268670 B1 11/2019
WO 2015124237 A1 8/2015
WO 2016071014 A1 5/2016
WO 2017041967 A1 3/2017
WO WO-2019068421 A1 * 4/2019 ..... F24C 15/2035

OTHER PUBLICATIONS

German Examination Report issued in corresponding German patent application No. 102019213610.9, filed Sep. 6, 2019.

* cited by examiner

*Primary Examiner* — Steven B McAllister
*Assistant Examiner* — Cole N Friedman
(74) *Attorney, Agent, or Firm* — Perry + Currier, Inc.

(57) ABSTRACT

An inflow nozzle for an intake opening of a device for downward extraction of cooking vapours has a supporting structure and a plurality of pin-like elements arranged on the supporting structure.

10 Claims, 3 Drawing Sheets

INFLOW NOZZLE

CROSS-REFERENCE TO RELATED APPLICATIONS

This application claims the priority of German Patent Application, Serial No. DE 10 2019 213 610.9, filed on Sep. 6, 2019 pursuant to 35 U.S.C. 119(a)-(d), the content of which is incorporated herein by reference in its entirety as if fully set forth herein.

FIELD OF THE INVENTION

The invention concerns an inflow nozzle for an intake opening of a device for extracting cooking vapours. The invention furthermore concerns a hob system.

BACKGROUND OF THE INVENTION

DE 20 2011 005 698 U1 describes a hob with a central extraction opening for downward extraction of cooking vapours. Furthermore, it is known from the prior art to insert a protective mesh in the intake opening.

SUMMARY OF THE INVENTION

It is an object of the invention to improve an insert for an intake opening of a device for downward extraction of cooking vapours.

This object is achieved by an inflow nozzle for an intake opening of a device for downward extraction of cooking vapours, comprising a supporting structure and a plurality of pin-like or shingle-type elements arranged on the supporting structure.

The core of the invention is to structure the insert as an inflow nozzle which has a plurality of pin-like elements.

During operation of the device for downward extraction of cooking vapours, the inflow nozzle may remain in the intake opening. It need not be removed therefrom. However, for example for cleaning purposes, it may be reversibly removed from the intake opening. In particular, it can be removed from the intake opening without tools.

The pin-like elements may have different functions. In particular, they form a filter device.

The number of pin-like elements may in particular be at least 9, in particular at least 16, in particular at least 25, in particular at least 36, in particular at least 49, in particular at least 100. The number of pin-like elements is preferably at most 1000, in particular at most 500, in particular at most 300.

A larger number of pin-like elements means that the total surface area can be enlarged.

According to one aspect of the invention, the pin-like elements are arranged in a regular pattern, in particular evenly distributed.

The inflow nozzle may in particular have a round, in particular a circular outer periphery. Means disrupting the symmetry may be provided on the outer periphery of the inflow nozzle. This may force or ensure a clearly defined, predetermined orientation of the inflow nozzle in the intake opening.

The inflow nozzle may also have a quadrangular, in particular a rectangular, in particular oblong or square outer periphery.

According to a further aspect of the invention, the inflow nozzle comprises a supporting structure. The pin-like elements can be arranged on the supporting structure.

The inflow nozzle can have a one-piece embodiment. It can also be built in several parts. In particular, the pin-like elements can be built in one-piece with the supporting structure. They can also be removable from the supporting structure. In particular, they can be removable one by one from the supporting structure. They can also be built as a connected structure. This connected structure can be separated from the supporting structure.

According to a further aspect of the invention, the supporting structure is formed as a grid structure.

This leads in particular to a high mechanical stability.

The supporting structure may in particular comprise a plurality of struts, which are in particular arranged perpendicularly to each other. It may in particular comprise at least 5, in particular at least 7, in particular at least 10 struts running substantially parallel to each other along a first direction, and a corresponding number running along a second direction perpendicular thereto.

The struts may be composed of several part pieces. They may in particular extend parallel to the x and y directions of a Cartesian coordinate system. Also, additional struts may be arranged diagonally thereto. The struts may be configured to be continuous.

The struts can also have a curved shape, in particular a doubly curved shape. They can in particular form sections from a doubly curved surface. Herein, the axes of the principle curvatures can be oblique, in particular perpendicular to each other.

Instead of a curved shape the struts can be formed by parts having a flat surface and being joined to each other such, that there is a kink between two adjacent parts.

The struts may in particular have a shingle-type embodiment. They can in particular have a scaled shape. The supporting structure is in particular designed such, that with respect to the cross sectional area of the inflow nozzle the proportion of shadows cast by the supporting structure in case of a perpendicular projection is larger than the proportion of the cross sectional area of the supporting structure at a given height. By this, it is possible to build the nozzle with an optically dense appearance whilst maintaining an only little obstructed, in particular virtually unobstructed flow trough. The proportion of the shadowed area of the supporting structure can be at least 10%, in particular at least 20%, in particular at least 30%, in particular at least 50% larger than the proportion of the minimal cross sectional area of the supporting structure with respect to the entire area of the inflow nozzle.

According to a further aspect of the invention, the grid structure is formed from unitary cells. The unitary cells preferably each have an identical outer periphery.

The unitary cells may have a triangular, square or hexagonal cross-section. They may also have a cruciform cross-section.

The unitary cells may also have a curved boundary, at least in sections.

The unitary cells are in particular configured such that they can be arranged as adjacent tiles next to one another in one plane. They may in particular allow gap-free arrangement as adjacent tiles in the plane. It is also possible that a space is left for one of the pin-like elements in the region between adjacent unitary cells.

According to a further aspect of the invention, the grid structure is formed from unitary cells with identical outer periphery, wherein of any two laterally adjacent unitary cells, one has a free inner cross-section and one has a wall traversing the inner cross-section.

The wall traversing the inner cross-section in particular runs in a diagonal direction of the respective unitary cell.

Thus there may be two different types of unitary cell. Identical unitary cells may adjoin each other in the diagonal direction. In particular, they may have precisely one common corner. Two unitary cells adjoining at the corner, i.e. two unitary cells sharing a common corner, both of which have a wall traversing the inlet cross-section, may be oriented such that the two walls traversing the inner cross-sections are rotated by 90° relative to each other.

According to a further aspect of the invention, the supporting structure may be formed as a compression element. The supporting structure may in particular be formed as a cross-linked structure.

The supporting structure, in particular the unitary cells and/or the pin-like elements, may be configured and/or arranged such that the flow cross-section has constrictions and/or widenings in the flow direction, i.e. parallel to a central axis of the inflow nozzle. The flow cross-section may also have a combination of constrictions and widenings. The flow cross-section may in particular be formed as an hourglass in regions.

This applies in particular to the unitary cells of the supporting structure.

The supporting structure and/or the pin-like elements may also serve as flow guidance elements or at least perform a flow guidance function.

In particular in case of a curved, in particular doubly curved embodiment of the struts of the supporting structure, they can perform a flow guidance function. This can lead to an improvement in the rate of fat separation.

According to a further aspect of the invention, the pin-like elements each have a free end.

The pin-like elements may have a cross-section which is constant over at least 50%, in particular at least 70%, in particular at least 90% of their length.

The cross-section of the pin-like elements lies in particular in the range from 4 $mm^2$ to 100 $mm^2$; it may in particular be at least 8 $mm^2$, in particular at least 15 $mm^2$, in particular at least 20 $mm^2$. The cross-section of the pin-like elements is in particular at most 80 $mm^2$, in particular at most 60 $mm^2$.

The pin-like elements may also have a cross-section which varies over their length. In particular, they may be formed tapering towards the free end. It is also possible for them to widen towards the free end. Combinations of these variants are also possible. In particular, it is possible to arrange the pin-like elements alternately in a row, the one tapering towards the free end and the next widening towards the free end.

By targeted variation of the cross-section of the pin-like elements and/or targeted arrangement of pin-like elements with cross-section varying over their length, the inflow behaviour of the nozzle can be influenced.

The pin-like elements may have a length of at least 5 mm, in particular at least 1 cm, in particular at least 1.5 cm, in particular at least 2 cm, in particular at least 3 cm, in particular at least 4 cm, in particular at least 5 cm. Here, the length is preferably measured from the top of the supporting structure facing the pin-like elements. It may also be measured starting from the underside of the supporting structure facing away from the free ends of the pin-like elements.

The underside of the supporting structure may be formed to be flat. The underside of the supporting structure may also be formed with a convex or concave curve.

The pin-like elements may be configured such that their free ends all lie in a common plane. This allows objects, such as for example cooking utensils, to be deposited on the inflow nozzle.

According to a further aspect of the invention, the pin-like elements are each connected to the supporting structure in the region of intersection points of the supporting structure configured as a grid structure.

The pin-like elements are in particular arranged in rectilinear rows. They are in particular arranged at the corners of a square grid.

The pin-like elements may in particular be configured and/or arranged such that a clear viewing angle range through the inflow nozzle is at most 90°, in particular at most 80°, in particular at most 70°, in particular at most 60°. A clear viewing angle range here means the maximum angle between two different directions which allows a clear view through the inflow nozzle.

A reduction of the clear viewing angle range can also be achieved by a particular design of the supporting structure.

The supporting structure can in particular be designed to lead to a free through flow area in projection, which is at most 70%, in particular at most 50%, in particular at most 30%, in particular at most 20%, in particular at most 10% of the total projected area of the inflow nozzle. This is true for a projection at any angle, in particular for a vertical projection. The free through flow area in projection is hereby defined as the proportion of the projected maximal area of the inflow nozzle, which is not shadowed by the supporting structure in case of a projection at a given angle, in particular in case of a vertical projection.

The pin-like elements may be designed to be substance-bonded to the supporting structure. They may in particular be formed integrally with the supporting structure.

The pin-like elements can also be separate from the supporting structure. They can in particular be reversibly linked to the supporting structure. In this case, they can be reversibly joinable with the supporting structure one by one or all together. In the latter case they form in particular a single connected part.

The pin-like elements may have a ratio of length to cross-section of at least 0.2/mm, in particular at least 0.3/mm, in particular at least 0.5/mm.

A high ratio of length to cross-section increases the free flow cross-section for the same contact area.

The total surface area of each of the pin-like elements may be at least 100 $mm^2$, in particular at least 200 $mm^2$, in particular at least 300 $mm^2$, in particular at least 500 $mm^2$. The surface area of the pin-like elements may in total or at least in regions serve as a reaction surface.

The total surface area of all pin-like elements may in particular amount to at least 100 $cm^2$, in particular at least 200 $cm^2$, in particular at least 300 $cm^2$, in particular at least 500 $cm^2$.

A larger total surface area of the pins leads to a larger total surface area available as a reaction surface, in particular for filter processes.

The pin-like elements may also cause an eddying of the inflowing air. This may lead to an increase in the contact time of the inflowing air with the filter device.

According to a further aspect of the invention, the pin-like elements each have a free end, wherein the free ends of two closest neighbouring pin-like elements are each configured differently.

The free ends of the pin-like elements may in particular be chamfered towards two opposing sides. They in particular may be chamfered so as to form a roof shape. The roof gable here runs along a diagonal of the cross-section of the pin-like elements. This is also described as a diamond design of the free ends.

It may be provided that each of the pin-like elements adjoins precisely one of the unitary cells of the supporting structure in which the wall traversing the inner cross-section runs towards the pin-like element. The orientation of the roof gable of the chamfers in this case may be oriented in parallel, in particular in continuation of the wall traversing the inner cross-section.

According to a further aspect of the invention, the surface density of the pin-like elements is at least 0.1 $cm^{-2}$, in particular at least 0.2 $cm^{-2}$, in particular at least 0.3 $cm^{-2}$, in particular at least 0.5 $cm^{-2}$, in particular at least 1 $cm^{-2}$. The surface density of the pin-like elements may in particular amount to at most 4 $cm^{-2}$.

A larger surface density here leads to a smaller free flow cross-section of the inflow nozzle. A larger surface density of the pin-like elements leads to a larger reaction surface thereof.

According to a further aspect of the invention, the free flow cross-section of the inflow nozzle is at least as large as 25% of a total cross-section of the inflow nozzle. The free flow cross-section is in particular at most as large as 90%, in particular at most 70%, in particular at most 50% of the total cross-section of the inflow nozzle. This is true for a cross-section at any height of the inflow nozzle. It can also refer to the values at a certain height, in particular at the height with the largest free flow cross-section or the smallest free flow cross-section.

The inflow nozzle in particular has a perforated surface. Here in particular, the free flow cross-sections of the unitary cells of the supporting structure may form the perforations.

The inflow nozzle may form a compression element.

According to a further aspect of the invention, the inflow nozzle is formed at least in regions from a plastic which is heat-resistant up to at least 250° C. The inflow nozzle may also be formed at least in regions from metal.

The inflow nozzle may also be used for depositing hot objects, in particular cooking utensils.

According to a further aspect of the invention, the inflow nozzle has a total extent of at least 1 cm, in particular at least 2 cm, in the direction parallel to a central axis. The total extent of the inflow nozzle in this direction is in particular at most 10 cm, in particular at most 5 cm.

The free ends of the pin-like elements may protrude beyond an outer boundary, in particular a boundary ring of the inflow nozzle, in the direction parallel to a central axis. They may also terminate flush with the outer boundary of the inflow nozzle in the direction of the central axis, or be set back downward relative to the outer boundary.

According to a further aspect of the invention, the inflow nozzle is configured as a filter device or is connected to a filter. In particular, it may be formed as a grease filter and/or an odour filter and/or as a moisture filter, or be connected to a corresponding filter. This aspect is in particular also independent of the geometric structure and structural design of the inflow nozzle.

According to a variant, the inflow nozzle can be without the pin-like elements. The supporting structure can still be according to the preceding description. In particular, the supporting structure can be designed to lead to a small clear viewing angle range and/or a small free through flow proportion.

According to a further variant the inflow nozzle comprises shingle-type, in particular scaled elements instead of pin-like elements. The shingle-type elements can be curved, in particular doubly curved.

The shingle-type elements can be embodied as single, separate elements or connected to form a single connected structure. For further details reference is made to the previous description, in particular with respect to the features of the pin-like elements and/or their connection to the supporting structure.

A further object of the invention is to improve a hob system.

This object is achieved by a hob system with an inflow nozzle according to the description above.

The hob system comprises at least one hob with at least one hotplate and at least one opening for extracting cooking vapours. The hob is in particular a glass plate, in particular a glass ceramic plate. The hob may also be made of metal.

The hob system usually has at least two, in particular at least three, in particular at least four hotplates.

The extraction opening may be arranged centrally in the hob. In particular it may be formed so as to be round, in particular circular. It may also be elongate, in particular rectangular. Here, the corners may be rounded.

The extraction opening can also be square or cross shaped.

The hob system is preferably configured as a combination device. This means that at least one hotplate also comprises a device for extracting cooking vapours. The hotplate and the extraction device are in particular integrated into a single device. This is therefore also described as a mounting unit.

Further details and features of the invention are described below with reference to FIGS. 1 to 3.

DESCRIPTION OF THE PREFERRED EMBODIMENTS

Figure 1:
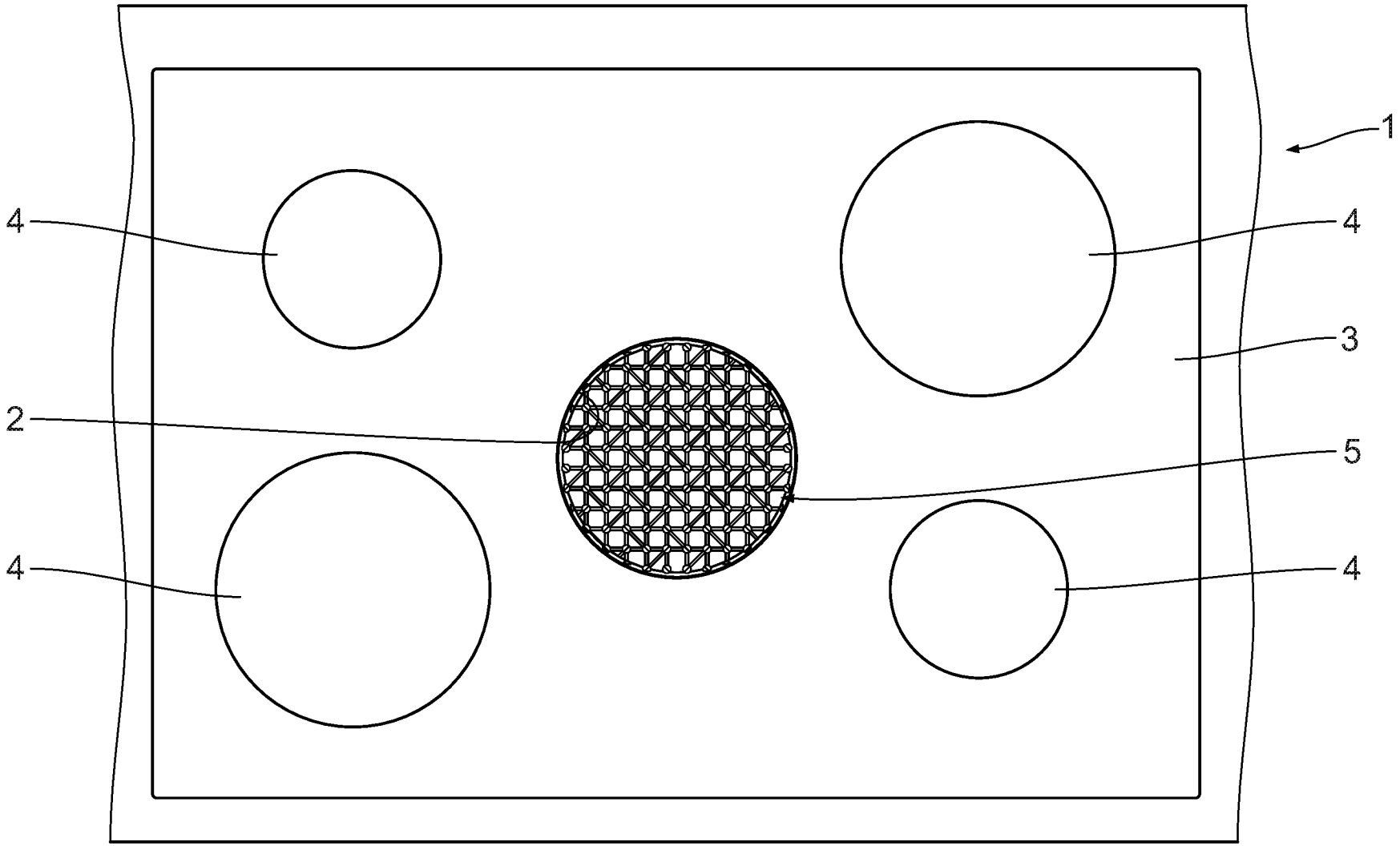
FIG. 1 shows as an example, a top view of a hob system with four hotplates, an opening for downward extraction of cooking vapours, and an inflow nozzle inserted in this opening.

FIG. 1 shows as an example a hob system 1 with an opening 2 for downward extraction of cooking vapours.

The hob system 1 comprises a hob 3. The hob 3 comprises a glass plate or a glass ceramic plate. The hob 3 has four hotplates 4.

The hob system 1 also has a device (not shown in the figures) for extracting cooking vapours. This is in particular arranged below the hob 3. It may be arranged directly on the hob 3 or on a component for operation of the hob system 1. The hob system 1 is in particular a combination device. The hob system 1 is in particular configured as a mounting unit. For further details, reference is made for example to EP 2 975 327 B1.

An inflow nozzle 5 is inserted in the opening 2.

Details of the inflow nozzle 5 are described below with reference to the exemplary FIGS. 2 and 3.

Figure 2:
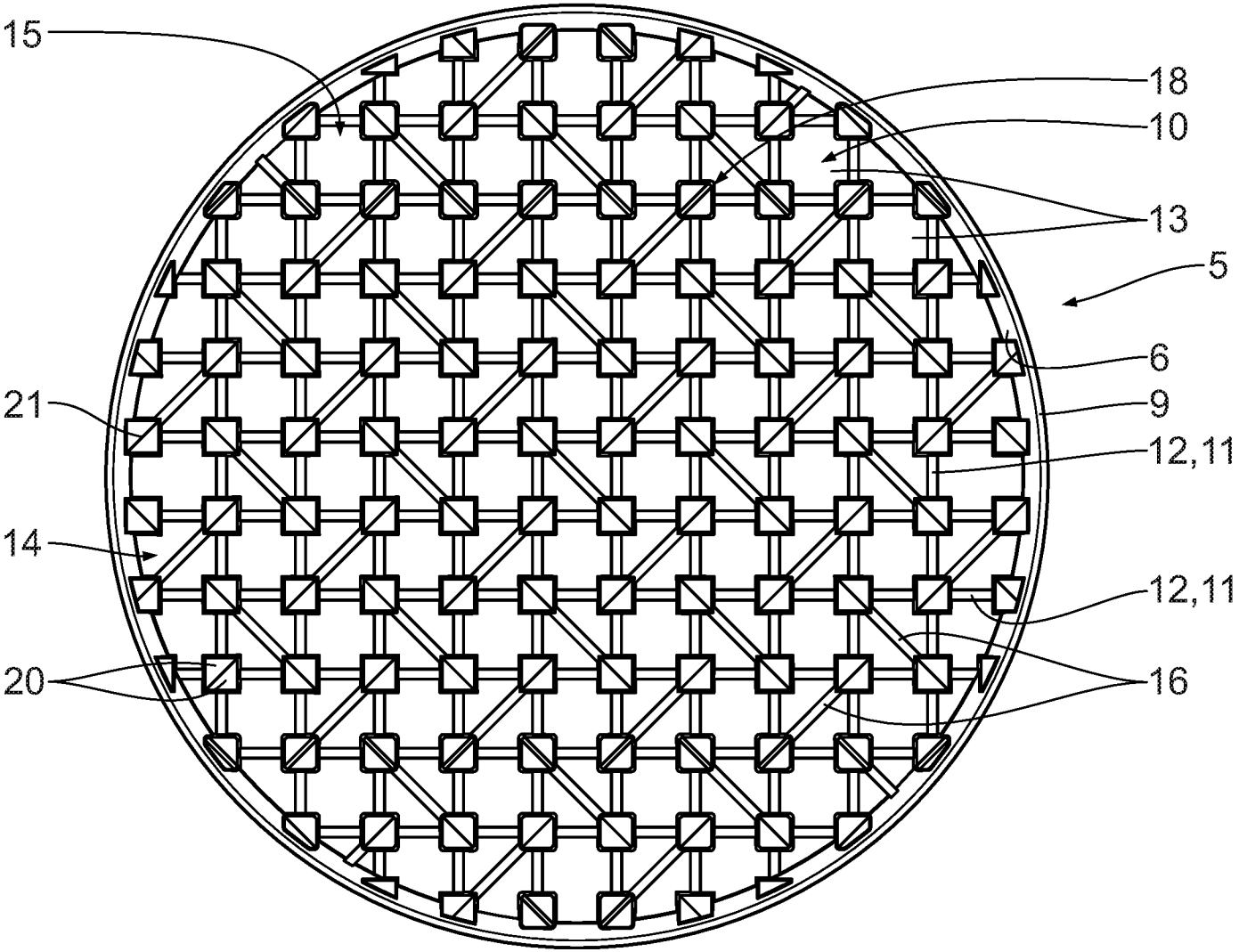
FIG. 2 shows as an example, a variant of an inflow nozzle for insertion in the extraction opening of the hob system according to FIG. 1.
Figure 3:
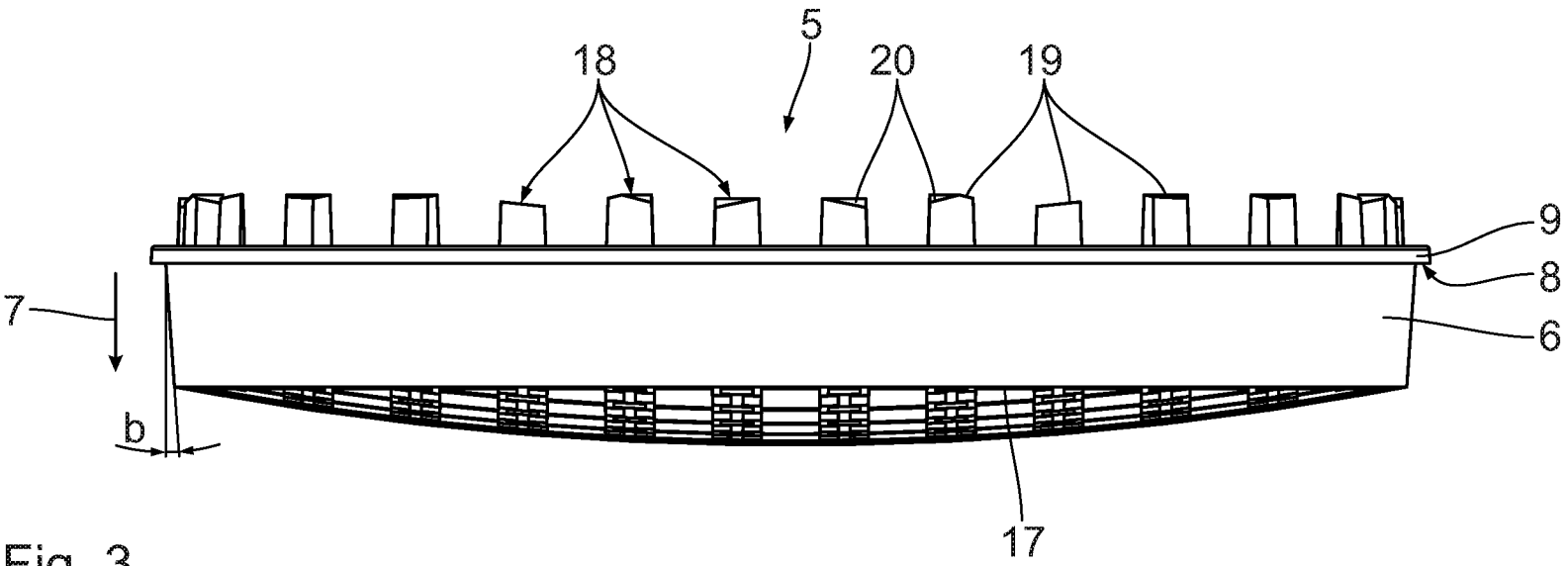
FIG. 3 shows a side view of the inflow nozzle from FIG. 2.

FIGS. 2 and 3 show a top view and a side view respectively of a variant of the inflow nozzle 5. The inflow nozzle 5 has a circular border 6. The border 6 may be made from plastic, in particular a plastic which is heat-resistant up to at least 250° C., or from metal. The border 6 is formed tapering conically in the inflow direction 7. This facilitates insertion of the inflow nozzle 5 in the opening 2. A flank angle b lies preferably in the range from 1° to 10°.

The border 6 has a contact shoulder 8.

The border 6 in particular has an upper edge 9 which protrudes beyond the rest of the border 6 in the direction perpendicular to the inflow direction 7.

The upper edge 9 may also be formed as a bead. It may also have a flat top side.

The upper edge 9 may be configured as a decorative ring, for example made of metal. In particular, it may be visually delimited from the remainder of the border 6.

A sealing element, for example in the form of an O-ring, may be arranged in the region of the contact shoulder 8. Such a sealing element is preferably releasably connected to the inflow nozzle 5. In particular, it may be removed for cleaning purposes.

The border 6 in particular surrounds a supporting structure 10. The supporting structure 10 comprises a plurality of struts 11. At least some of the struts 11 are oriented parallel to the axes of a Cartesian coordinate system.

The struts 11 are in particular formed so as to be rectilinear. In particular, they have rectilinear part pieces 12.

The struts 11 may also be formed so as to be continuous.

The supporting structure 10 in particular forms a grid structure. The grid structure 10 comprises a plurality of unitary cells 13.

The struts 11 delimit a plurality of unitary cells 13. According to the variant in FIG. 2, the unitary cells 13 are formed so as to be substantially square. In particular, they are formed so as to be cruciform-square. This means that they have a cruciform free inner cross-section which is inscribed into a square base form.

The unitary cells 13 are arranged in rows 14 and columns 15.

Laterally adjacent unitary cells 13 each share a common part piece 12 of a strut 11. Of any two laterally adjacent unitary cells 13, one has a free inner cross-section while the other has a diagonally running transverse strut 16.

Precisely one of the transverse strut 16 ends at each of the intersection points of the struts 11.

Unitary cells 13 with free inner cross-section and unitary cells 13 with a transverse strut 16 alternate in the rows 14 and columns 15. Within a given row 14 or given column 15, all transverse struts 16 have the same orientation. The transverse struts 16 of adjacent rows 14 or adjacent columns 15 are rotated by 90° relative to each other.

A unitary cell 13 with free inner cross-section is in particular adjacent to two unitary cells 13 with transverse struts 16 in a first direction, and two unitary cells 13 with transverse struts 16 in a second direction running perpendicularly to the first direction.

Each unitary cell 13 with a transverse strut 16 is laterally adjacent to four unitary cells with free inner cross-section.

Each unitary cell 13 with a transverse strut 16 in a first direction lies adjacent at the corners to four unitary cells 13 with transverse struts 16 in a second direction oriented perpendicularly to the first direction.

Each unitary cell 13 with free inner cross-section lies adjacent at the corners to four further unitary cells 13 with free inner cross-section.

The supporting structure 10 is convex in the inflow direction 7, i.e. curved towards the outside. Alternatively, it may also terminate flat with a lower edge 17 of the inflow nozzle 5.

A pin-like element 18 is arranged at each intersection point of two struts 11. The pin-like elements 18 have a square cross-section. As shown in FIG. 1 as an example, they may also have a round cross-section. Other cross-sectional forms are also possible.

The pin-like elements 18 protrude beyond the upper edge 9 of the border 6 in the direction opposite the inflow direction 7. This is not absolutely essential. They may also have free ends 19 which lie in a common plane with the upper edge 9, or are set back relative to the upper edge 9 in the inflow direction. The latter may be advantageous in order to provide the inflow nozzle 5 with a cover-like closing element. The inflow nozzle 5 may in particular be closed air-tightly and/or fluid-tightly and/or opaquely by means of a corresponding cover or cover-like element (not shown in the figures).

The free ends 19 of the pin-like elements 18 each have a double chamfer 20. Each chamfer 20 runs from a gable 21 oriented along a diagonal.

Each gable 21 is oriented in the direction of the transverse struts 16 adjoining at the intersection point.

The pin-like elements 18 are arranged in rows and columns. In a given row or column, the orientation of the gables 21 alternates. Along a 45° diagonal, all gables 21 have the same orientation.

The pin-like elements 18 may each have a roughened surface. This may improve contact with the extracted cooking vapour stream.

The pin-like elements 18 may also have a smooth surface. This facilitates cleaning of the inflow nozzle 5.

The inflow nozzle 5 may in particular be placed in a dishwasher. It is in particular made of dishwasher-resistant material.

According to a variant, the inflow nozzle 5 may be heated in the oven for cleaning and/or regeneration and/or activation. In particular, it is heat-resistant up to at least a temperature of 200° C., in particular at least 250° C., in particular at least 300° C., in particular at least 400° C.

The supporting structure 10 lies behind the pin-like elements 18 in the inflow direction 7. In the inserted state of the inflow nozzle 5, in particular it lies below the pin-like elements 18.

The supporting structure 10 is preferably substantially invisible when the inflow nozzle 5 is inserted in the opening 2. In particular, it is visible exclusively when viewed from a narrowly restricted angular range. In particular, the formation and/or arrangement of the pin-like elements 18 may suggest a substantially closed surface of the inflow nozzle 5.

The inflow nozzle 5 may in particular have a perforated surface. The free flow cross-sections of the unitary cells 13 may here form the perforations.

According to a variant of the invention, the inflow nozzle 5 may be provided with one or more filter elements. The filter elements may in particular be reversibly removably connected to the inflow nozzle 5, in particular to the border 6 and/or the supporting structure 10. The filter elements may in particular be exchangeable. The filter element may be a grease filter and/or an odour filter and/or a moisture filter (moisture separator).

The inflow nozzle 5 itself, in particular the supporting structure 10 and/or the pin-like elements 18, may also have a filter effect. It may in particular be configured as a grease filter and/or odour filter and/or moisture filter.

What is claimed is:

1. An inflow nozzle for an intake opening of a device for downward extraction of cooking vapours, comprising:

a supporting structure; and a plurality of pins arranged on the supporting structure, wherein the supporting structure is formed as a grid structure, and the grid structure is formed from unitary cells with identical outer periphery, the grid structure comprising a checkerboard pattern of adjacent cells with transverse struts and cells without transverse struts; and wherein the transverse struts of any two cells that have transverse struts and share a corner are oriented in different directions.

2. The inflow nozzle according to claim 1, wherein each of the plurality of pins have a free end.

3. The inflow nozzle according to claim 1, wherein each of the plurality of pins have a free end, and the free ends of two closest neighbouring pins are each configured differently.

4. The inflow nozzle according to claim 1, wherein the surface density of the plurality of pins is at least 0.1 $cm^{-2}$.

5. The inflow nozzle according to claim 1, further comprising a free flow cross-section which is at least as large as 25% of a total cross-section of the inflow nozzle.

6. The inflow nozzle according to claim 1, wherein:

the plurality of the pins comprises one or more of: a grease filter; an odour filter and a moisture filter, or the plurality of the pins is connected to one or more of a grease filter, an odour filter and a moisture filter.

7. The inflow nozzle according to claim 1, wherein the supporting structure has a clear viewing angle range for the inflow nozzle that is at most 90°.

8. A hob system comprising:

a hob with:

at least one hotplate; and at least one opening for downward extraction of cooking vapours; and an inflow nozzle inserted in the at least one opening, the inflow nozzle comprising:

a supporting structure; and a plurality of pins arranged on the supporting structure, wherein the supporting structure is formed as a grid structure, and the grid structure is formed from unitary cells with identical outer periphery, the grid structure comprising a checkerboard pattern of adjacent cells with transverse struts and cells without transverse struts.

9. The inflow nozzle according to claim 1, wherein of any two cells that are adjacent and share a side, one has a free inner cross-section and the other has a transverse strut traversing the inner cross-section.

10. The hob system according to claim 8, wherein of any two cells that are adjacent and share a side, one has a free inner cross-section and the other has a transverse strut traversing the inner cross-section.

* * * * *